US005221214A

United States Patent [19]

Martin

[11] Patent Number: 5,221,214

[45] Date of Patent: Jun. 22, 1993

[54] ELECTRICAL CONNECTOR FOR SUBMERSIBLE PUMP TANDEM MOTORS

[75] Inventor: Fred S. Martin, Claremore, Okla.

[73] Assignee: Baker Hughes Incorporated, Houston, Tex.

[21] Appl. No.: 890,715

[22] Filed: May 29, 1992

[51] Int. Cl.[5] ..... H01R 4/60

[52] U.S. Cl. ..... 439/191; 439/205

[58] Field of Search ..... 439/191, 205, 206, 271, 439/733, 735, 736, 737, 607

[56] References Cited

U.S. PATENT DOCUMENTS

| | | | |
|---|---|---|---|
| 2,967,289 | 1/1961 | Day | 439/737 |
| 3,241,095 | 3/1966 | Phillips | 439/205 |
| 4,691,430 | 9/1987 | Wheeler | 439/275 |
| 4,859,200 | 8/1989 | McIntosh et al. | 439/275 |
| 4,907,980 | 3/1990 | Wagaman et al. | 439/206 |
| 5,070,940 | 12/1991 | Conner et al. | 439/191 |

FOREIGN PATENT DOCUMENTS

| | | | |
|---|---|---|---|
| 2137438 | 10/1984 | United Kingdom | 439/205 |

OTHER PUBLICATIONS

Drawing of Prior Electrical Connector from the Applicant Sent in May 29, 1992.

*Primary Examiner*—Larry I. Schwartz
*Assistant Examiner*—Hien D. Vu
*Attorney, Agent, or Firm*—James E. Bradley

[57] ABSTRACT

An electrical connector for interconnecting tandem motors of an electrical submersible well pump utilizes single piece metal pins and sleeves. Each half of the connector has insulators located in the body. Metal connection sleeves are located in holes in the insulators. The connection sleeves have threads for securing to threads formed in the insulators. The metal connection pins also have threads for securing to threads formed in the insulators. The connection sleeves and connection pins have axial slots formed on their exteriors.

8 Claims, 1 Drawing Sheet

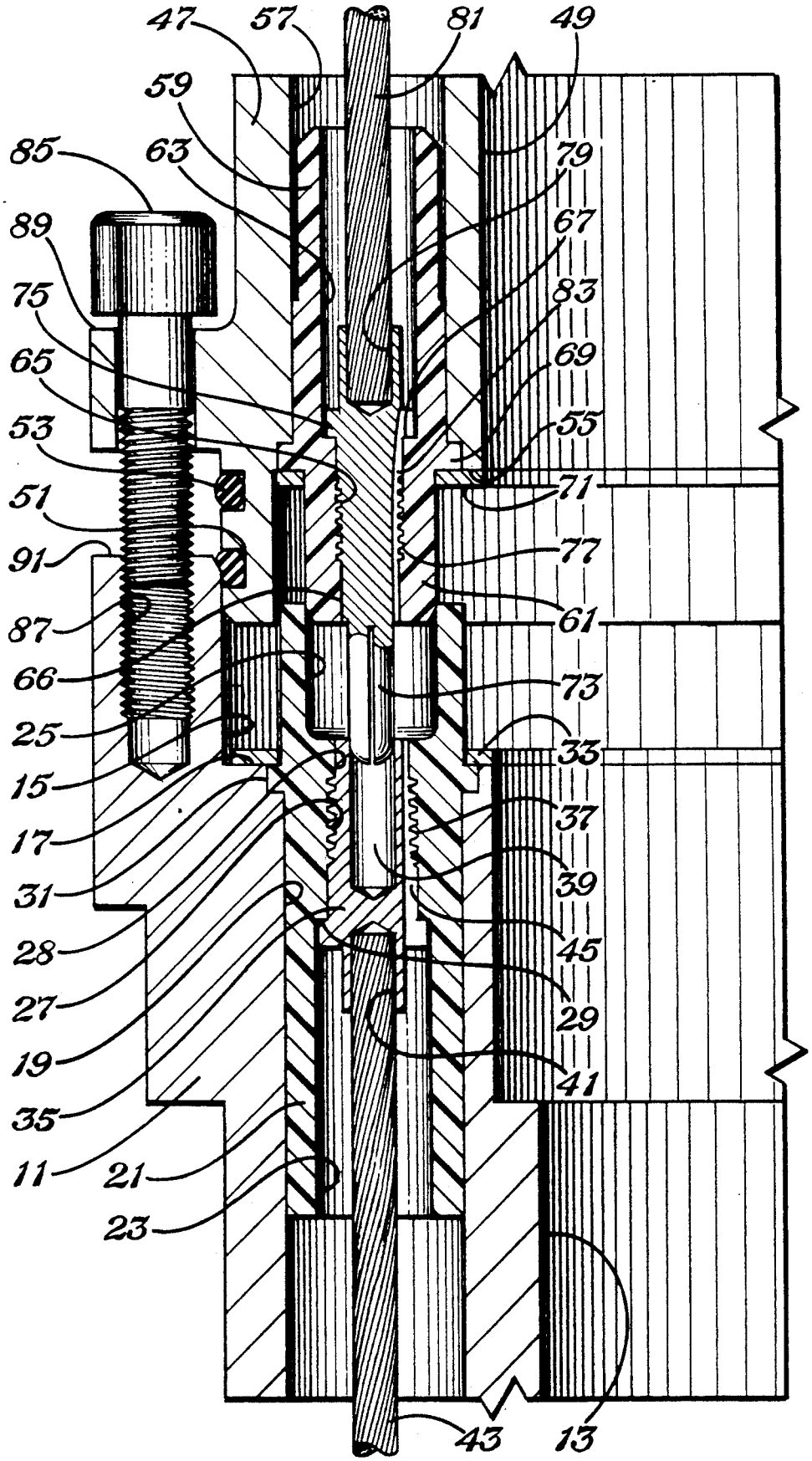
47
57
81
49
59
85
63
79
89
67
75
83
65
69
53
55
51
71
91
77
87
61
66
73
25
33
15
37
17
39
31
45
28
29
27
19
41
35
11
21
23
43
13

ELECTRICAL CONNECTOR FOR SUBMERSIBLE PUMP TANDEM MOTORS

BACKGROUND OF THE INVENTION

1. Field of the invention

This invention relates in general to electrical connectors, and in particular to an electrical connector for interconnecting submersible pump tandem motors.

2. Description of the Prior Art

In an electrical submersible pump installation using tandem motors, the pump and two motors will be located in the well and suspended on a string of tubing. A power cable will extend down through the casing of the well alongside the tubing. An electrical connection connects the power cable to the upper electrical motor. Another electrical connection connects the lower end of the upper motor to the upper end of the lower motor. The motors and the electrical interconnection between the motors are filled with an insulating and lubricating oil.

The prior art electrical connectors work sufficiently well. However, improvements are desired. For example, in the prior type, if water leaks into the upper motor, the water may gravitate downward and into the electrical interconnection. There is no means for disposing off any water that might collect in the receptacles of the electrical connectors. Moreover, there is no easy means for bleeding off any trapped air that is displaced upward as the lower motor is filled from the bottom with the lubricating oil during assembly.

In the prior art, each metal connector sleeve assembly and each metal connector pin assembly is a two piece design. These two piece designs utilize metal threaded members which are tightened against portions of insulators. These connections tend to loosen with time due to cold flow of the insulators.

SUMMARY OF THE INVENTION

In this invention, the electrical connector between the tandem motors utilizes insulators which are internally threaded, unlike the prior art insulators which had smooth, unthreaded bores. Each metal connector member is of a single piece design, having a wire joined to one end. Each metal connector member is threaded for securing in the threads formed in the insulator.

Also, each metal connection member has a vertical slot or channel that extends through the threads. This channel allows trapped water to bleed downward and out of exposure to the electrical contacts. The channel also allows displaced air to pass upward through the electrical connections during filling of the motors with oil.

BRIEF DESCRIPTION OF THE DRAWING

The sole figure is a quarter sectional view of a portion of an electrical connector constructed in accordance with this invention for connecting between electrical submersible pump tandem motors.

DETAILED DESCRIPTION OF THE INVENTION

The motor head electrical connector has a head or female body 11 which has an axial passage 13 through which the motor shaft (not shown) extends. Body 11 secures to the upper end of a lower tandem motor (not shown). Passage 13 is enlarged at its upper end, resulting in an inner cylindrical wall 15. A base 17 locates at the lower end of inner cylindrical wall 15. Base 17 is an annular shoulder encircling passage 13 and facing upward. A plurality of holes 19 (only one shown) extend through base 17. Holes 19 are parallel to passage 13 and evenly spaced around passage 13. Normally, there will be three holes 19, one for each phase of three phase AC power.

A female insulator 21 locates within each hole 19 Each female insulator 21 is of an insulating material and has an axial passage 23 extending completely through it. The upper portion of passage 23 is enlarged, defining a receptacle 25. Receptacle 25 extends above base 17. A set of threads 27 locate directly below receptacle 25 within a reduced midsection area of passage 23. The lower portion of passage 23 is of larger diameter than the threads 27. This results in a downward facing shoulder 29 located within the lower portion of passage 23. The upper end of threads 27 is a selected distance below receptacle 25, resulting in a smooth pilot bore 28 in passage 23 immediately above threads 27.

Each female insulator 21 has an external flange 31 that locates within an enlarged portion at the upper end of hole 19. A retaining ring 33 locates above flange 31 to secure each female insulator 21 to the female body 11. Retaining ring 33 may be secured to base 17 by fastener means such as screws (not shown).

A connection sleeve 35 secures within each female insulator 21. Connection sleeve 35 is a metallic conductor. Connection sleeve 35 has external threads 37 that screw into internal threads 27 in the female insulator 21. The upper end of the external threads 37 locates at the lower end of pilot bore 28. A smooth cylindrical portion of connection sleeve 35 fits tightly in pilot bore 28, with the upper end of connection sleeve 35 being flush with the bottom of receptacle 25. Connection sleeve 35 has a receptacle 39 within it that has a closed bottom. Connection sleeve 35 also has a socket 41 on its lower end. One of the electrical wires 43 will insert into socket 4 and will be joined to socket 41, preferably by soldering. Electrical wires 43 extend downward to the lower tandem motor (not shown).

A vertical channel 45 extends along the exterior sidewall of connection sleeve 35. Channel 45 extends completely from the upper end to the lower end of connection sleeve 35, passing through threads 37. Channel 45 allows any water migrating downward from the upper motor to flow downward past threads 37. Channel 45 also allows upward flow of displaced air during filling with oil.

The electrical connector also includes a base or male body 47 that attaches to the lower end of an upper tandem motor (not shown). Male body 47 secures to female body when the tandem motors are connected together. Male body 47 has a longitudinal passage 49 through it that will be coaxial with passage 13 of female body 11 once connected. The shaft of the motors (not shown) will extend through passage 49. Male body 47 has an external cylindrical wall 51 that inserts within cylindrical wall 15 of female body 11. A pair of O-ring seals 53 located on an external cylindrical wall 51 seal against inner cylindrical wall 15. A base or downward facing shoulder 55 locates at the upper end of external cylindrical wall 51. A plurality of holes 57 (only one shown) are spaced around shoulder 55, each in alignment with one of the holes 19 in female body 11.

A male insulator 59 locates within each hole 57. Male insulator 59 has a downward protruding mandrel 61 that is cylindrical and sized for tight close reception within receptacle 25. An axial passage 63 extends completely through male insulator 59, providing an opening at the lower end of mandrel 61. A plurality of threads 65 are located in passage 63 in the portion of passage 63 located within mandrel 61. The lower end of threads 65 is spaced above the lower end of passage 63, resulting in pilot bore 66 portion of passage 63 that is cylindrical and smooth.

Passage 63 has an upward facing shoulder 67, separating the portion of passage 63 that is in mandrel 61 from the portion above. Male insulator 59 has an external flange 69 that fits within a circular recess in shoulder 55. A retaining ring 71 secures the male insulators 59 in place by abutting against the flanges 69. Screws (not shown) secure the retaining ring 71 to the shoulder 55.

A metal connection pin 73 secures within each passage 63. Connection pin 73 has a split pin on its end that protrudes past mandrel 61 for insertion within receptacle 39. Connection pin 73 has a flange 75 that is external for abutting against shoulder 67. External threads 77 on connection pin 73 will engage threads 65 to secure connection pin 73 in male insulator 59. A socket 79 locates on the upper end. A wire 81 will be joined to socket 79, preferably by soldering. Although not visible in the drawing, pin 73 protrudes past the lower end of mandrel 61 slightly less than the depth of receptacle 25. This assures that the mandrel 61 will enter receptacle 25 before the pin 73 enters receptacle 39.

A vertical or axial extending channel 83 extends along one side of the exterior of connection pin 73, completely through the threads 77. Channel 83 will allow any water migrating downward from the upper motor to flow through mandrel 61 and downward through channel 45. Channel 83 also allows air to bleed during filling of oil in the motor.

Male body 47 secures to female body 11 in a conventional manner. A plurality of bolts 85 secure the bodies 11, 47 together. Bolts 85 engage threaded holes 87 in female body 11. Bolts 85 extend through a flange 89 that is on the exterior of male body 47. Bolts 85 will pull the flange 89 into abutment with a rim 91 located on the upper end of female body 11.

During assembly, the female body 11 will be secured to the upper end of a lower tandem motor. The male body 47 will be secured to the lower end of an upper tandem motor. The motors will be connected together by securing the male body 47 to the female body 11. During this process, the pins 73 will be aligned with the sleeves 35. The male body 47 is pushed toward the female body 11. Tightening bolts 85 pulls the flange 89 into engagement with rim 91. Insulating oil is pumped into the assembled tandem motors from the lower end of the lower tandem motor. As the oil flows upward, it will displace air. Any air trapped below female connection sleeves 35 will flow upward through channels 45 and 83. The connection pins 73 and sleeves 35 will be completely immersed in oil.

During operation, power for the lower motor is supplied through the electrical connection pins 73 and sleeves 35. If water enters the upper motor and migrates downward into the passages 63 of the male insulators 59, the water will flow downward through the channels 45, 83, out of contact with the connection sleeves 35 and pins 73.

The invention has significant advantages. The channels allow any water and air to be displaced out of the area of the electrical contacts. Securing the electrical contacts directly into threads in the insulators makes them less subject to being loosened with time due to cold flow of the insulators. The connection sleeves and connection pins are one piece, allowing fewer parts for the assembly. Fewer components also reduces the chance for loose electrical connections. The electrical connector is easier to assemble than the prior art type.

While the invention has been shown in only one of its forms, it should be apparent to those skilled in the art that it is not so limited, but is susceptible to various changes without departing from the scope of the invention.

I claim:

1. In an electrical submersible well pump having tandem upper and lower motors and an electrical connector for interconnecting the motors, the connector having a female body secured to one of the motors and having a longitudinal axis and at least one hole extending therethrough and a base parallel with the longitudinal axis, the connector having a male body secured to the other of the motors that inserts sealingly and coaxially within the female body and having at least one hole extending therethrough parallel with the longitudinal axis, the improvement comprising in combination:

at least one female insulator, each secured in one of the holes in one of the bodies, each of the female insulators having an axial passage therethrough which has a receptacle;

a set of threads integrally formed in the passage in each of the female insulators;

at least one metal connection sleeve, each having one end joined to an electrical wire which extends from one of the motors through one of the holes in one of the bodies, each sleeve having an exterior with a set of threads integrally formed thereon which engage the threads in the passage in one of the female insulators;

at least one male insulator, each secured in one of the holes in the other of the bodies, each of the male insulators inserting into one of the receptacles of one of the female insulators, each male insulator having an axial passage therethrough;

a set of threads integrally formed in the passage in each of the male insulators; and at least one metal connection pin, each having one end joined to an electrical wire which extends from the other of the motors through one of the holes in said other of the bodies, each pin having an exterior having a set of threads integrally formed thereon which engage the threads in the passage in one of the male insulators, each pin inserting into one of the connection sleeves when the bodies are inserted together.

2. The electrical connector according to claim 1 further comprising means cooperating with each of the female insulators and connection sleeves and each of the water that may migrate into contact with the interior of the electrical connector to flow downward past each of the connection sleeves and connection pins and through each of the holes and around each of the electrical wires, and for allowing air venting during filling of oil in the motors, allowing air to be displaced upward through each of the holes around each of the electrical wires.

3. The electrical connector according to claim 1 further comprising an axially extending channel extending through a selected one of the sets of the threads of the female insulators and connection sleeves, fluid communicating the receptacle of each of the female insulators with one of the holes in said one of the bodies, and an axially extending channel extending through a selected one of the sets of the threads of the male insulators and connection pins, fluid communicating the axial passage of each of the male insulators with one of the holes in said other of the bodies, for allowing any water that may migrate into contact with the interior of the electrical connector to flow downward past the electrical connector from the upper motor to the lower motor, and for allowing air venting from the lower motor to the upper motor during filling of oil in the motors.

4. The electrical connector according to claim 1 further comprising an axially extending channel connection pins, fluid communicating the axial passage in each of the male insulators with each of the holes in said other of the bodies, and an axially extending channel extending through the set of threads of each of the connection sleeves, fluid communicating the receptacle in each of the female insulators with one of water that may migrate into contact with the interior of the electrical connector to flow downward past the electrical connector from the upper motor to the lower motor, and for allowing air venting from the lower motor to the upper motor during filling of oil in the motors.

5. In an electrical submersible well pump having tandem upper and lower motors, an electrical connector for interconnecting the motors, comprising in combination:

a female body secured to one of the motors and having a longitudinal axis, a cylindrical bore, a central base encircled by the bore and being perpendicular to the longitudinal axis, and at least one hole extending through the base parallel with the longitudinal axis;

a male body secured to the other of the motors and having a longitudinal axis, a cylindrical wall that inserts within the bore of the female body, a central base encircled by the wall and being perpendicular to the longitudinal axis of the male body, and at least one hole extending through the base parallel with the longitudinal axis;

seal means for sealing the cylindrical wall to the bore;

fastener means for securing the bodies together with the wall sealingly located inside the bore;

at least one female insulator, each secured in one of the holes in one of the bodies, with an extension portion protruding past the base of the body in which the insulator is secured, each of the female insulators having an axial passage therethrough which has a receptacle in the extension portion and a reduced diameter portion joining the receptacle;

a set of threads integrally formed in the reduced diameter portion of the passage in each of the female insulators;

at least one metal connection sleeve, each having one end joined to an electrical wire extending from said one of the motors through one of the holes in said one of the bodies, each sleeve having an exterior with a set of threads integrally formed thereon which engage the threads in the reduced diameter portion of the passage in one of the female insulators;

at least one male insulator, each secured in one of the holes in the other of the bodies, each male insulator having a mandrel protruding past the base of the body in which the male insulator is secured, each of the mandrels inserting into one of the receptacles of one of the female insulators, each male insulator having an axial passage therethrough;

a set of threads integrally formed in the passage in each of the male insulators;

at least one metal connection pin, each having one end joined to an electrical wire extending from said other of the motors through one of the holes in said other of the bodies, each pin having an exterior having a set of threads integrally formed thereon which engage the threads in the passage in one of the male insulators, each pin inserting into one of the connection sleeves when the bodies are secured together by the fastener means; and flowby means cooperating with each of the female insulators and connection sleeves and each of the male insulators and connection pins, for allowing any water that may migrate into contact with the interior of the electrical connector to flow downward from the upper motor through the holes in the bodies to the lower motor past each of the connection sleeves and connection pins, and for allowing air venting during filling of oil in the motors from the lower motor through the holes in the bodies to the upper motor.

6. The electrical connector according to claim 5 wherein the flowby means comprises an axially extending channel extending through a selected one of the sets of the threads of the female insulators and connection sleeves from the one of the holes in said one of the bodies to the receptacle in each of the female insulators, and an axially extending channel extending through a selected one of the sets of the threads of the male insulators and connection pins from one of the holes in said other of the bodies through the axial passage in each of the male insulators.

7. The electrical connector according to claim 5 wherein the flowby means comprises an axially extending channel extending through the set of threads of each of the connection sleeves, fluid communicating one of the holes in said one of the bodies with the receptacle in each of the female insulators, and an axially extending channel extending through the set of threads of each of the connection pins, fluid communicating one of the holes in said other of the bodies with the axial passage in each of the male insulators.

8. In an electrical submersible well pump having upper and lower tandem motors, an electrical connector for interconnecting the motors, comprising in combination:

a female body secured to one of the motors and having a vertical axis, a cylindrical bore, an upward facing central base encircled by the bore and being perpendicular to the vertical axis, and at least one hole extending through the base parallel with the vertical axis;

a male body secured to the other of the motors and having a vertical axis, a cylindrical wall that inserts within the bore of the female body, a downward facing central base encircled by the wall and being perpendicular to the vertical axis of the male body, and at least one hole extending through the base parallel with the vertical axis of the male body;

seal means for sealing the cylindrical wall to the bore;

fastener means for securing the bodies together with the cylindrical wall sealingly located inside the bore;

at least one female insulator, each secured in one of the holes in one of the bodies, with an extension portion protruding upward past the base of the body in which the female insulator is secured, each of the female insulators having an axial passage therethrough which has a receptacle in the upper portion, a midsection joining the receptacle, and a lower section joining the midsection, the midsection being of smaller diameter than the lower section, defining a downward facing shoulder;

a set of threads integrally formed in the midsection of the passage in each of the female insulators;

at least one metal connection sleeve, each having one end joined to an electrical wire extending from said one of the motors through one of the holes in said one of the bodies, each sleeve having an exterior with a set of threads integrally formed thereon which engage the threads in the midsection of the passage in one of the female insulators, each connection sleeve having a flange which abuts the downward facing shoulder in the passage;

at least one male insulator, each secured in one of the holes in the other of the bodies, each male insulator having a mandrel protruding downward past the base of the body in which the male insulator is secured and which inserts into one of the receptacles of one of the female insulators, each male insulator having an axial passage therethrough and an upward facing shoulder formed therein;

a set of threads integrally formed in the passage in each of the male insulators below the upward facing shoulder;

at least one metal connection pin, each having one end soldered to an electrical wire extending from said other of the motors through one of the holes in said other of the bodies, each pin having an exterior having a set of threads integrally formed thereon which engage the threads in the passage in one of the male insulators, each pin inserting into one of the metal sleeves when the bodies are secured together by the fastener means, each of the pins having a flange formed thereon which abuts the upward facing shoulder in the passage in the male insulator; and an axially extending channel extending through the set of threads of each of the connection pins, fluid communicating each of the holes in said other of the bodies with the axial passage in each of the male insulators, and an axially extending channel extending through the set of threads of each of the connection sleeves, fluid communicating each of the holes in said one of the bodies with the receptacle in each of the female insulators, allowing the migration of water downward through the holes in each of the bodies from the upper motor to the lower motor, and allowing air to be displaced upward through the holes in each of the bodies from the lower motor to the upper motor during filling of motor oil.

* * * * *